United States Patent [19]

Pelletier et al.

[11] 4,249,981

[45] Feb. 10, 1981

[54] DEVICE FOR FORMING A WEB OF PARALLEL THREADS

[76] Inventors: Jacques Pelletier, "Le Tremblay" Albigny-sur-Saone, 69250 Neuville-sur-Saone; Regis Berliet, 87, Grande Rue de la Croix Rousse, 69004 Lyons, both of France

[21] Appl. No.: 973,533

[22] Filed: Dec. 26, 1978

[30] Foreign Application Priority Data

Mar. 14, 1978 [FR] France ..... 78 08065

[51] Int. Cl.[2] ..... D04H 3/04

[52] U.S. Cl. ..... 156/441; 28/100; 66/84 A; 156/181; 28/172

[58] Field of Search ..... 156/181, 441, 440, 439, 156/176, 178, 177, 179, 306; 28/100, 101, 102; 66/84 A; 226/74, 78, 119, 118, 87, 81, 182, 184, 186, 173; 242/53

[56] References Cited

U.S. PATENT DOCUMENTS

| | | | |
|---|---|---|---|
| 2,812,797 | 11/1957 | Estel et al. | 156/181 |
| 3,340,584 | 9/1967 | Kalwaiter | 156/440 |
| 3,594,256 | 7/1971 | Schuller et al. | 156/440 |
| 3,616,067 | 10/1971 | Treckmann | 156/441 |
| 3,785,175 | 1/1974 | Kamp | 66/84 A |
| 3,949,111 | 4/1976 | Pelletier | 156/181 |

*Primary Examiner*—Michael W. Ball

*Attorney, Agent, or Firm*—Stevens, Davis, Miller & Mosher

[57] ABSTRACT

The invention relates to a device for producing weft webs consisting of parallel spaced threads, in which at least one weft thread is fed around positioning, holding and advancing elements which consist of continuous endless belts which support a plurality of juxtaposed blocks which have a length corresponding substantially to the desired spacing between two consecutive weft threads. The blocks are in contact with one another in the rectilinear portions of the endless belt and spaced in the curved portion as they pass around drive rollers. At least one reciprocating thread guide has a free end which passes between the blocks in the curved portion of each endless belt, to feed thread between the blocks.

9 Claims, 6 Drawing Figures

DEVICE FOR FORMING A WEB OF PARALLEL THREADS

BACKGROUND TO THE INVENTION

The present invention relates to an improved device for forming a web consisting of parallel spaced threads, extending transversely relative to the length of the web.

In the description which follows, such a web will be referred to by the expression "weft web" and the threads constituting the web will be referred to by the expression "weft threads".

Very many devices are currently used for producing weft webs which are intended to be combined with longitudinal parallel threads, the cohesion of the whole being provided, for example, by gluing so as to form articles usually referred to by the expression "non-woven textile nets". These weft webs can optionally also be used as they are, for example as a non-woven reinforcing element for paper, or even as an element employed in the manufacture of knitted articles produced by the so-called "frontal weft insertion" technique, which consists of incorporating, over the entire length of the knitting machine or Raschel machine, a weft thread into each row of stitches or in accordance with a defined frequency.

A well-known technique for producing such weft webs, which is described in particular in French Pat. Nos. 1,335,418, 1,367,567 and 1,537,811, consists, in general terms, of distributing a plurality of weft threads around pegs arranged on two endless belts which are separated from one another by a distance corresponding to the width of the web which it is desired to produce. According to this technique, the element which dispenses the weft thread is located above the two endless belts carrying the pegs and consists of a revolving unit which, in the course of its rotation, places the threads between, and around, the said pegs.

Such a device is complex, especially because it requires special guide members for positioning the weft threads around the pegs, if it is desired to obtain webs consisting of threads which are strictly parallel to one another. Furthermore, it is rather awkward to ensure that the weft threads are held around the pegs, as the threads can easily slip off the pegs.

Another, very old technique which is mentioned in the abovementioned patents for the production of articles of the non-woven net type consists in causing the longitudinal threads to advance intermittently and dispensing the transverse threads during the pause periods, the transverse threads thus being selected at the edges of the strip. In this technique, the same problem as previously arises, namely how to hold the ends of the transverse threads or weft threads.

SUMMARY OF THE INVENTION

According to the present invention there is provided a device for producing weft webs consisting of parallel spaced threads, said apparatus comprising in combination:

(a) two substantially parallel continuous endless belts separated from one another by a distance equal to the width of the web to be formed;

(b) two rotary drive rollers associated with each belt, whereby the belts each have curved portions as they pass around the drive rollers and rectilinear portions between the drive rollers;

(c) a plurality of blocks mounted on each endless belt so as to be in juxtaposed relation to one another in said rectilinear portions of the belts and spaced apart from one another in the curved portions; and (d) feed means for feeding at least one weft thread from a fixed source, said feed means comprising at least one reciprocating thread guide having a free end moving on a path transverse to said endless belts and passing alternately between the spaced apart blocks of one belt and the other in the curved portions thereof.

Such a device makes it possible to produce weft webs consisting of parallel threads extending transversely relative to the length of the web formed, which overcomes the disadvantages of the earlier devices and in particular makes it possible to hold the ends of the weft threads, thus deposited, in an efficient and precise manner, without risk of the threads escaping.

Advantageously, the endless continuous belts are slightly divergent from one another, which makes it possible to dispense the weft virtually without tension and to impart the desired tension to it during the advance of the web. In one embodiment, these endless continuous belts are metal belts having spaced apart apertures engaged by pegs on the drive rollers. The blocks mounted on the endless element are preferably made of synthetic rubber or of a similar plastics material which is relatively rigid but is advantageously slightly compressible, and are coupled to the continuous metal belt, and fixed thereto, by any appropriate means, for example by means of screws.

As stated above, the length of these blocks corresponds to the desired distance between two successive weft threads, and this length can vary within wide limits, depending on the desired article.

Where it is desired to produce very dense articles, these blocks can consist of simple metal strips, again firmly fixed to an endless support, but it is of course necessary, in accordance with the invention, that these strips should be in contact with one another in the rectilinear portions of the path of the said endless supports and should separate in the curved portions.

In place of the endless element consisting of a belt to which the blocks are coupled, it is optionally possible to use an element made in one piece, which is, for example, in the form of a crenellated belt, produced with notches, forming the blocks and extending over part of its thickness.

Furthermore, the amplitude of the intermittent advancing movement of the endless elements which position and hold the weft threads depends on the number of weft threads to be dispensed simultaneously and must be such that upon each movement and weft insertion, at least one thread is deposited between two consecutive blocks.

This intermittent advance can be achieved, for example, by means of a conventional ratchet and selector system.

The dispensing of the weft threads between the lateral elements is advantageously effected by means of thread guides mounted on a support subjected to a transverse reciprocating movement, while the continuous endless elements are stationary.

This control of the movements of the guide threads can be achieved, for example, by means of an endless band to which the thread guides are firmly fixed and which is driven by a motor of which the direction of rotation is alternated.

In a different embodiment, the alternating movement of the thread guides is also produced by means of a belt but in this case the belt always revolves in the same direction and has stops intended to drive the carriage at two different points, either to the right or to the left. In this case, the carriage is of course independent of the belt. This embodiment avoids inverting the direction of rotation of the motor and furthermore has the advantage that if the weft becomes jammed or over-tensioned, the carriage on which the thread guides are mounted can be stopped.

The invention, and the advantages which it provides will be better understood from the following description of a presently preferred embodiment of the invention, which is given merely by way of example, reference being made to the accompanying drawings.

DETAILED DESCRIPTION OF THE PREFERRED EMBODIMENT

The device illustrated comprises a feed means 1, which allow two weft threads to be fed simultaneously, and means 2 for positioning, holding and advancing the weft web formed.

Figure 1:
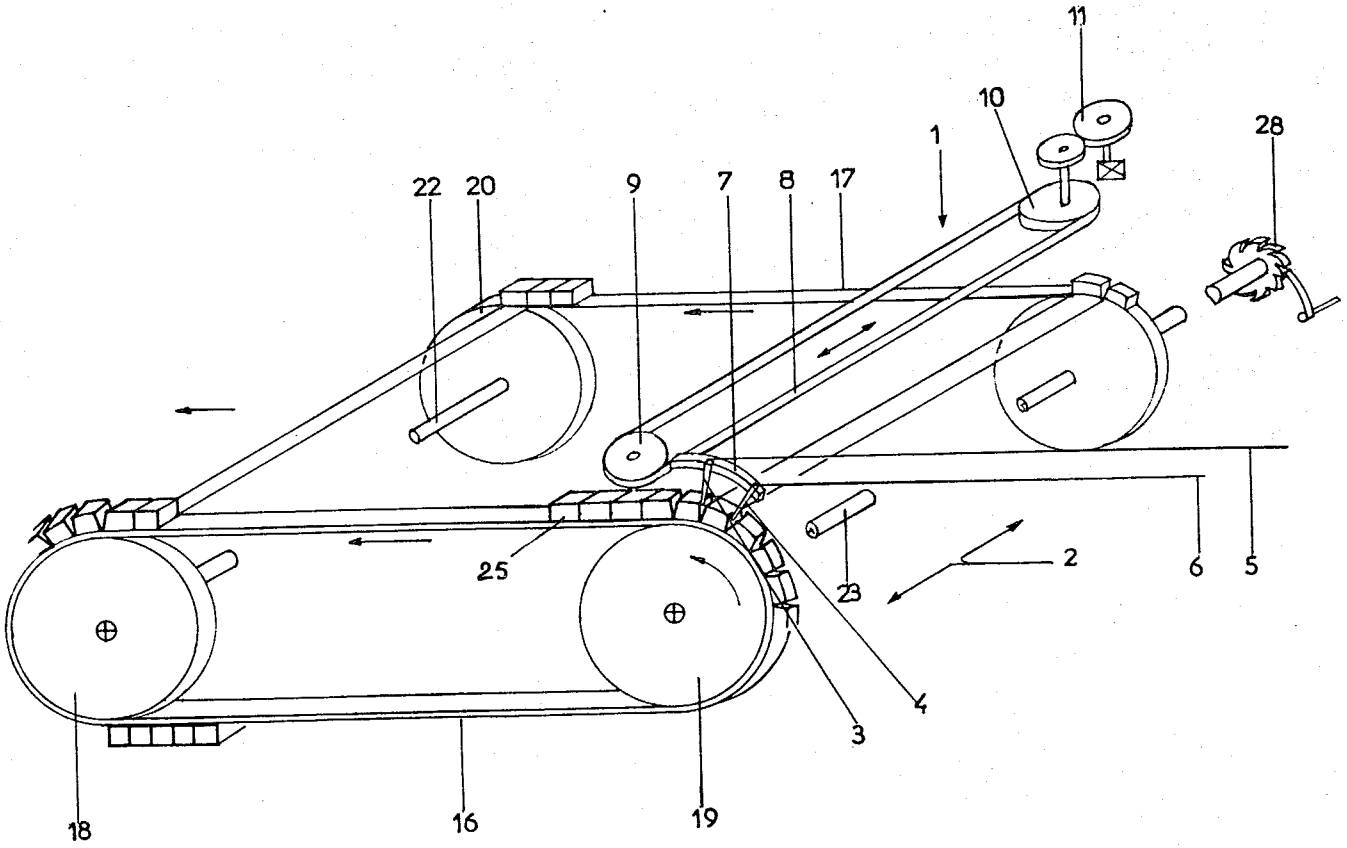
FIG. 1 is a schematical perspective view of the main parts of the embodiment of the device according to the invention, except that the framework is not shown.
Figure 2:
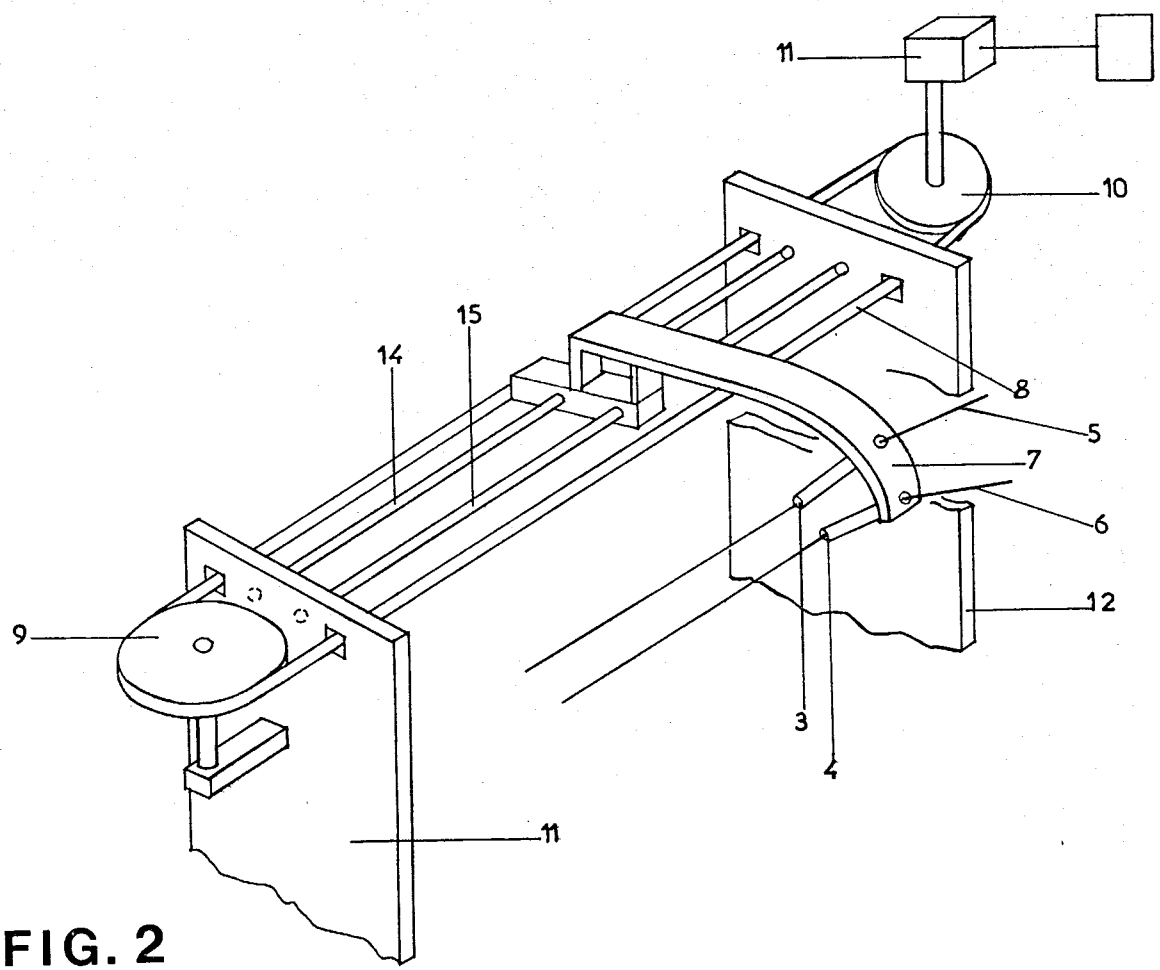
FIG. 2 is an enlarged perspective view, illustrating the means for feeding the weft threads to be dispensed between the lateral holding, advancing and positioning belts.

The feed means which are illustrated in more detail in FIG. 2 essentially consist of two tubular thread guides 3, 4 through which pass the threads 5, 6 to be fed, which threads originate from a fixed feed source which is not shown and consists, for example, of a creel carrying bobbins. The thread guide tubes are produced of any suitable material such as metal or plastic.

The thread guides 3 and 4 are mounted on a support 7 which can be moved alternately from one side of the installation to the other. This movement is produced, in a simple manner by two pulleys 9, 10 fixed to the framework 11, 12 of the device, one of the pulleys, for example the pulley 10, being driven, at a defined frequency, first in one direction and then in the other by means of a conventional step-down motor 11 controlled by an electrical reversing device. The guiding and holding of the support 7 is advantageously assisted by fixed slides 14, 15 located between the two sideplates 11, 12 of the framework. Below these feed means are arranged two positioning, holding and advancing elements 16, 17, which are in the form of an endless belt mounted on drive rollers or pulleys 18, 19, 20 and 21, which are also held by shafts 22, 23 carried on the framework of the device.

Figure 3:
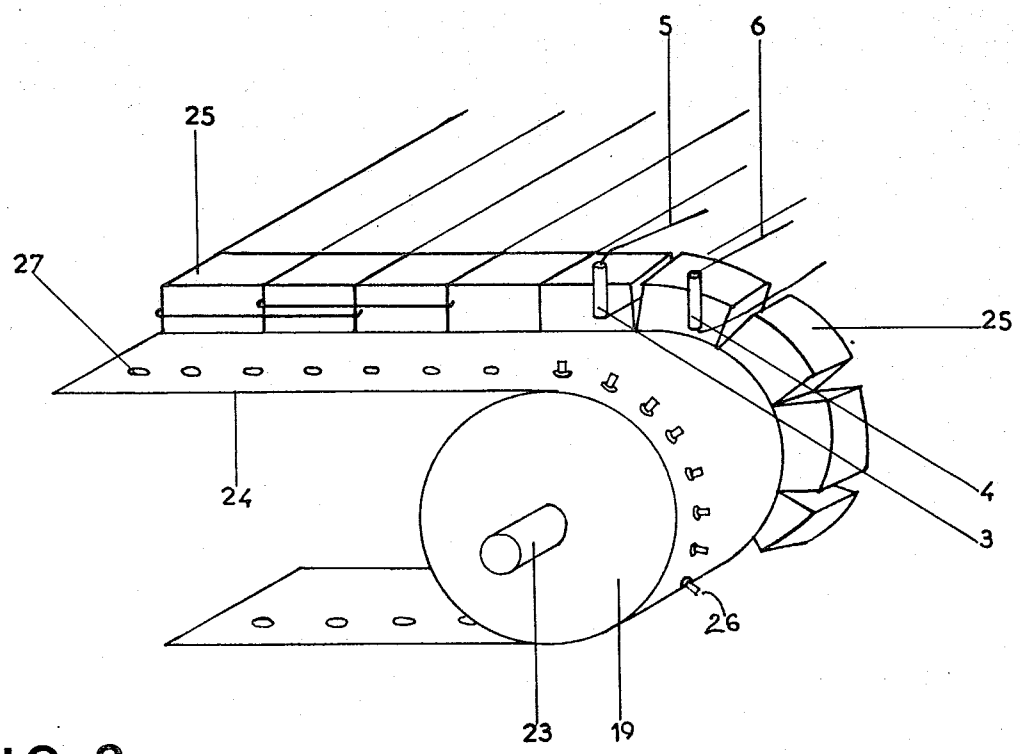
FIG. 3 is a frag mentary enlarged perspective view, which illustrates o ne form of the elements which hold, advance and position the weft threads.

The endless belts consist, as is shown more clearly in FIG. 3, of a continuous belt 24 on the surface of which is located a plurality of blocks 25, for example formed from synthetic rubber. These blocks are of parallelepipedonal shape and are in contact with one another in the rectilinear parts of the path of the endless elements, while they separate slightly in the curved parts.

The stepwise drive of these continuous belts can be achieved by providing, on the drive pulleys 18, 19, 20, 21, pegs 26 which cooperate with perforations 27 provided in the continuous belts.

This stepwise drive can for example be achieved by means of a ratchet 28 combined with an adjustable stabilization selector, which is not shown in the figures and which permits precise stepwise rotation of the shaft 23. Since such elements are well-known to those skilled in the art, it is superfluous to describe them in detail.

The distance of travel produced by the ratchet 28 depends on the weft thread to be inserted for one cycle of the machine.

The feeding of the weft threads, 5, 6 between the positioning, holding and advancing elements is effected by means of thread guides 3, 4 which are located on their support 7 and are of such length that their free end passes, during their travel, through the space between two consecutive blocks when the latter are separated on the curved part of the path of the continuous belts.

The mode of operation of such an installation is as follows.

With the means for positioning, advancing and holding the weft threads stationary, the motor 11 engaged and, by means of the belt 8, causes the thread guides 3, 4 to travel from one side of the device to the other. At the end of their travel, the motor is stopped, for example by means of a detector of the position of the support 7 of the thread guides.

During this travel, each thread guide feeds a weft thread on each side between two consecutive blocks. Thereafter, the separated holding elements are caused to advance, by means of the ratchet 28, by a predetermined amount which in the present case corresponds to a distance equal to the length of two blocks 25. The two previously deposited threads are thus firmly gripped on each side between two blocks, since during their advance, they pass from a curved zone, where they are separated, into a rectilinear zone where they are juxtaposed and tightly pressed against one another. The two thread guides 3 and 4 are then caused to return and hence two fresh weft threads are deposited. The cycle is then repeated.

Figure 4:
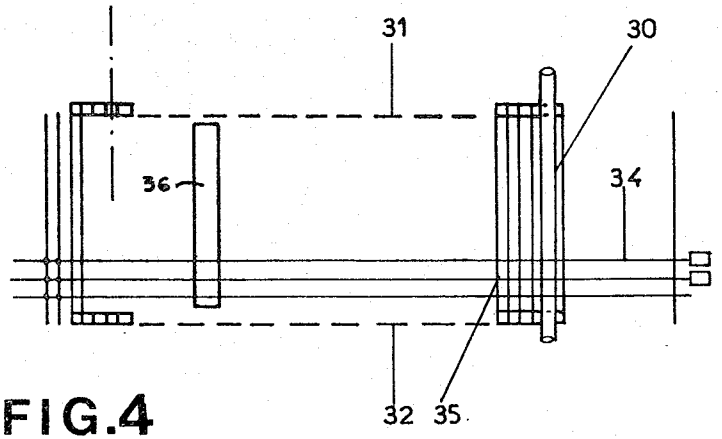
FIGS. 4 and 5 are schematic plan and side elevations of an installation including a device according to the invention which allows the production of articles consisting of a weft web combined with a web of longitudinal threads.
Figure 5:
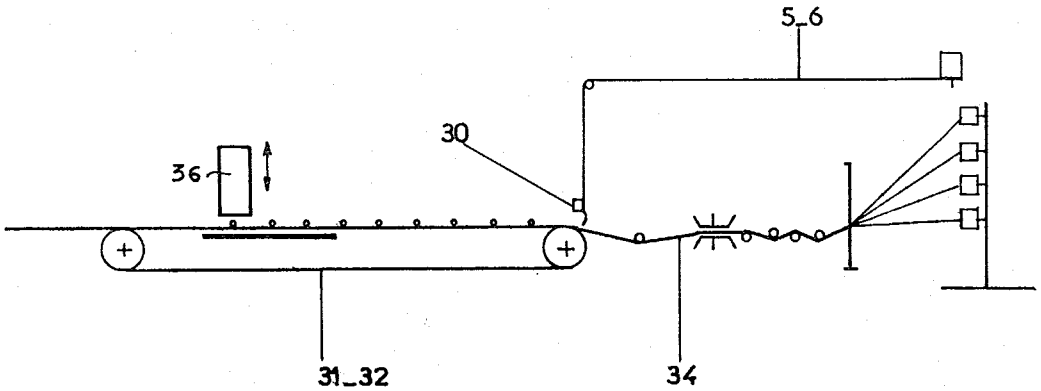

Such an installation can advantageously be used for producing articles in which a web of weft threads is combined with longitudinal threads, especially by heat-welding, in accordance with the teachings of French Pat. No. 2,209,004; such an installation is illustrated schematically in FIGS. 4 and 5.

In these figures, the means of dispensing, conducted in accordance with the invention, are marked with reference 30 and the lateral holding elements with references 31 and 32.

Figure 6:
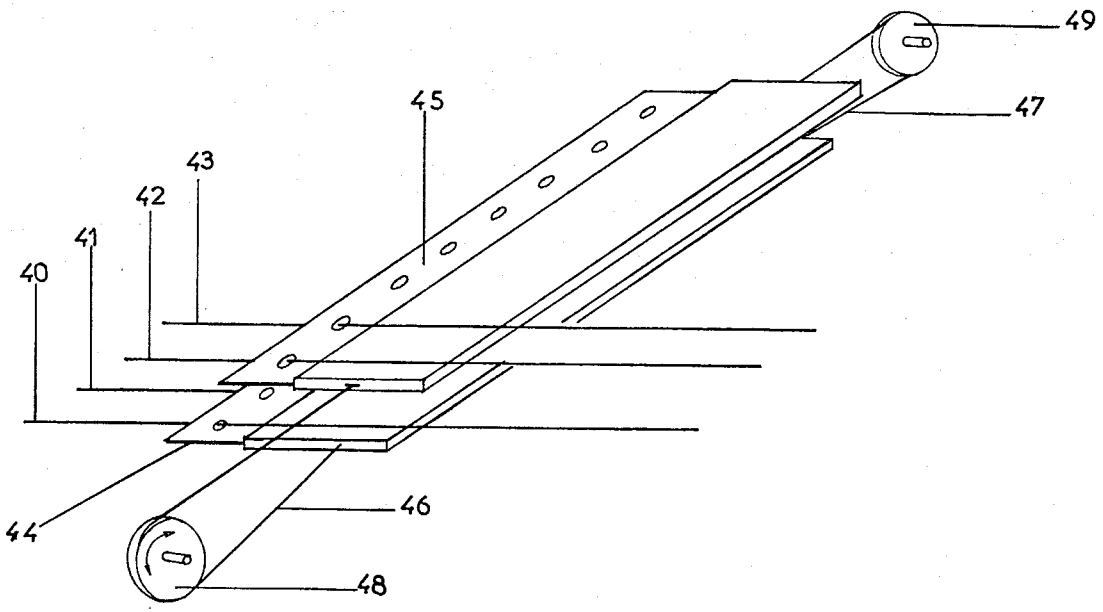
FIG. 6 illustrates a particular application according to which the longitudinal threads are combined with a weft web produced according to the invention, the said weft threads being shifted alternately so as to produce a diamond structure.

A web of warp threads 34 is superposed on the web of weft threads 35 formed according to the invent3ion, the threads being welded by a unit constructed in accordance with the teachings of French Pat. No. 2,209,004. In the present case, the pause time which is needed to cause the threads to weld together is utilized to deposit the weft threads by means of the dispensing element 30. There is thus neither any dead time nor any pause in production. If desired, the warp threads 40, 41, 42 and 43 can be alternately shifted transversely, as is shown in FIG. 6, so as to form, after combination with the weft threads, a complex which has a diamond shaped structure.

A simple method of causing the transverse shift of the threads consists of, for example, causing the even-numbered threads to pass through a guide 44 which is in the form of a plate having thread guide perforations, and to cause the odd-numbered threads to pass through a similar guide 45. These two guides are arranged one above the other and can be driven transversely by, for example, belts or the like, 46, 47 passing over two drive pulleys 48, 49 which can be driven in one direction or the other, by a defined amount, the signal to do so being triggered when the complex formed advances.

The invention is not restricted to the embodiment described above but instead embraces all variants realized in the same general sense.

Thus, it is conceivable to take the weft thread continuously from its feed, and deposit it by varying the movement of the thread guides synchronously with the advance of the lateral holding elements.

Furthermore, though in the present case the device described possesses, as the feed element, a unit which allows two weft threads to be delivered simultaneously, it is conceivable to use dispensers possessing more than two thread guide elements. The only requirement in that case is that the end of the guides should pass between the blocks when these are separated and that after the lateral conveyor elements have advanced by a defined amount the threads should be held firmly between the said blocks.

Finally, it is conceivable to mount a plurality of thread guides on a system which makes it possible to change the thread being dispensed, in accordance with a defined frequency, so as, for example, to produce color selection.

The weft web formed can advantageously be used for the production of perforated complex structures by combining it continuously with one or more warp thread webs; the various threads can be bonded to one another either by welding, as described above, or, where appropriate, by gluing.

If desired, such a web can be cut at its selvedges so as to obtain individual lengths of weft which it is possible to incorporate, for example, on a knitting machine employing frontal weft insertion.

Though in the present application the invention has been described principally for the case of intermittent advance of the weft web formed, it is obvious that a continuous advance of the said weft web can also be used without going outside the scope of the invention.

In that case, the weft dispensing element would also undergo a longitudinal movement effected simultaneously with its transverse movement and synchronized with the latter, so as to compensate for the lag which would interfere with the parallel arrangement of the weft threads, due to this continuous advance.

We claim:

1. A device for producing weft webs consisting of parallel spaced threads, said apparatus comprising, (a) two substantially parallel continuous endless belts separated from one another by a distance equal to the width of the web to be formed;

(b) two rotary drive rollers associateave curved portions as they pass around the drive rollers and rectilinear portions between the drive rollers;

(c) a plurality of blocks mounted on each endless belt so as to be in juxtaposed relation to one another in said rectilinear portions of the belts and spaced apart from one another in the curved portions; and (d) feed means for feeding at least one weft thread from a fixed source, said feed means comprising at least one reciprocating thread guide having a free end moving on a path transverse to said endless belts and passing alternately between the spaced apart blocks of one belt and the other in the curved portions thereof, said spaced apart blocks with the weft thread fed therebetween advancing with said belts from said curved portions to said rectilinear portions to bring adjacent blocks together whereby said weft threads are gripped therebetween.

2. A device as claimed in claim 1, wherein the continuous endless belts are metal belts, wherein said belts further comprise spaced apart apertures and said drive rollers further comprise pegs engagable in said apertures and wherein said blocks are produced from a relatively rigid but compressible material fixed to the continuous metal belt.

3. A device as claimed in claim 1 and further comprising a ratchet and selector system, for intermittently feeding the endless belts, and wherein the feed means are subjected to a transverse reciprocating movement while the continuous endless belts are stationary.

4. A device as claimed in claim 1, and further comprising means to move the continuous endless belts continuously, without pause, and means to subject the feed means to a longitudinal movement effected simultaneously with its transverse movement and synchronized with the latter, so as to compensate for the lag which would interfere with the parallel arrangement of the weft threads, due to this continuous advance of the endless belts.

5. A device as claimed in claim 3, and further comprising an endless band to which the thread guides are firmly fixed and which is driven by a motor of which the direction of rotation is alternated.

6. A device as claimed in claim 3, and further comprising an endless band, means to revolve said band always in the same direction, stops on said band and a carriage driven by the said band at two different points, either to the right or to the left, the said carriage being independent of the belt, said thread guides being mounted on said carriage.

7. A device as claimed in claim 1, wherein the two continuous endless belts diverge slightly.

8. A device as claimed in claim 1, and further comprising means to combine the weft thread web formed with longitudinal threads, the weft threads being fed during the pause time required to cause the threads to weld to one another.

9. A device according to claim 8, and further comprising means which allow the warp threads alternately to be moved transversely, these means consisting of two guides arranged one above the other, a transverse belt passing over two drive pulleys for driving said guides which can be driven in one direction or the other, by a defined amount, the signal for this movement being triggered when the web formed advances, and the even-numbered threads pass through one of the guides while the odd-numbered threads pass through the second guide.

* * * * *